US006909061B1

(12) United States Patent
Jong

(10) Patent No.: US 6,909,061 B1
(45) Date of Patent: Jun. 21, 2005

(54) TRIGGER-BRAKE STRUCTURE FOR TOOL MACHINE

(75) Inventor: Jung-Chang Jong, Chungli (TW)

(73) Assignee: Jenn Feng Industrial Co., LTD, Ping-Chang (TW)

( * ) Notice: Subject to any disclaimer, the term of this patent is extended or adjusted under 35 U.S.C. 154(b) by 0 days.

(21) Appl. No.: 10/819,203

(22) Filed: Apr. 7, 2004

(51) Int. Cl.[7] ..... H01H 13/00; H01H 13/14
(52) U.S. Cl. ..... 200/334; 200/43.17; 200/522
(58) Field of Search ..... 200/334, 43.11, 200/43.01, 43.17, 337, 522, 332.2, 321

(56) References Cited

U.S. PATENT DOCUMENTS 4,122,320 A 10/1978 Edgell et al.
5,195,164 A * 3/1993 Lambert ..... 392/385
5,575,285 A 11/1996 Takanashi et al.
5,724,737 A 3/1998 Stones
5,820,889 A * 10/1998 Erikson ..... 425/130
5,831,232 A * 11/1998 Kushnir et al. ..... 200/61.87
6,180,898 B1 * 1/2001 Terada et al. ..... 200/51 LM
6,469,265 B1 * 10/2002 Penix et al. ..... 200/50.32
6,469,269 B1 10/2002 Jong
6,548,776 B1 4/2003 Jong
6,753,490 B2 * 6/2004 Svetlik et al. ..... 200/321
6,777,636 B2 * 8/2004 Ahlert et al. ..... 200/401

* cited by examiner

*Primary Examiner*—K. Lee
(74) *Attorney, Agent, or Firm*—Birch, Stewart, Kolasch & Birch, LLP

(57) ABSTRACT

A trigger-brake structure for tool machine comprises a trigger device and a brake device arranged in a machine base, in which the trigger device is employed for starting a power switch while the brake device for constraining the power transmission. The trigger-brake structure for tool machine is characterized in that a transmission axle for power transmission is arranged in the machine base; a leverage trigger of the trigger device will apply force to another lever in the brake device when the trigger is rotated to move a self-restoring switch to therefore start the power of the machine base; and, the brake device is comprised of a flange of a spring for receiving a force applied by the trigger through a lever so that the stretch degree of a spring leaf surrounding the transmission axle can be controlled by the trigger device to thereby change the frictional force of contact surface between the spring leaf and the transmission axle.

1 Claim, 3 Drawing Sheets

TRIGGER-BRAKE STRUCTURE FOR TOOL MACHINE

BACKGROUND OF THE INVENTION

1. Field of the Invention

The present invention relates generally to a trigger-brake structure for tool machine, and particularly to a trigger and brake combination device disposed in an electric-powered tool to serve as a trigger-controlled brake device for control output of the power source.

2. The Prior Art

In consideration of the operation safety of a conventional portable tool machine, particularly an electric saw, a brake device is usually provided to enable or disable a power-transmission axle through a connected trigger device. In a brake structure, a brake rubber portion or the like is controlled by a trigger to permit the transmission of power of a tool machine to a power output end thereof for normal operation, or decrease gradually or close down the power source of the tool machine, otherwise.

SUMMARY OF THE INVENTION

In the brake structure of conventional tool machines, braking effect is achieved usually by means of friction between a brake rubber and a power transmission axle for fading the output power out until it is thoroughly died away. However, to stop a tool machine in this manner is something that does not conform to or satisfy with new regulations, because the power output cannot be stopped in one second. Moreover, since the brake rubber is inevitably aged and faded with time, any unexpected accident may happen because of a piece of deteriorated brake rubber. Thus, an improved trigger-brake structure for tool machine of the present invention will be introduced below in detail.

The trigger-brake structure for tool machine of the present invention mainly comprises a trigger device and a brake device arranged in a machine base, in which the trigger device is employed for starting a power switch while the brake device for constraining the power transmission. The trigger-brake structure for tool machine is characterized in that a transmission axle for power transmission is arranged in the machine base; a leverage trigger of the trigger device will apply force to another lever in the brake device when the trigger is rotated to move a self-restoring switch to therefore start the power of the machine base; and the brake device is comprised of a flange of a spring for receiving a force applied by the trigger through a lever so that the stretch degree of a spring leaf surrounding the transmission axle can be controlled by the trigger device to therefore change the frictional force of contact surface between the spring leaf and the transmission axle.

The advantages of the present invention may be summarized as the following:

(1) Through the stretch degree of the spring leaf controlled by the trigger in the trigger device of the trigger-brake structure for tool machine of the present invention, it is possible to change the frictional force of contact surface between the spring leaf and the transmission axle to decrease or stop the power output in one second in order to conform to and satisfy with relevant rules.

(2) Since the spring leaf is made of metal, instead of rubber, problems of aging and unexpected accident to be caused by the brake device can be waived.

(3) Labor is savable by using the trigger to apply force and loosen the spring leaf in way of lever application.

For more detailed information regarding advantages or features of the present invention, at least an example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
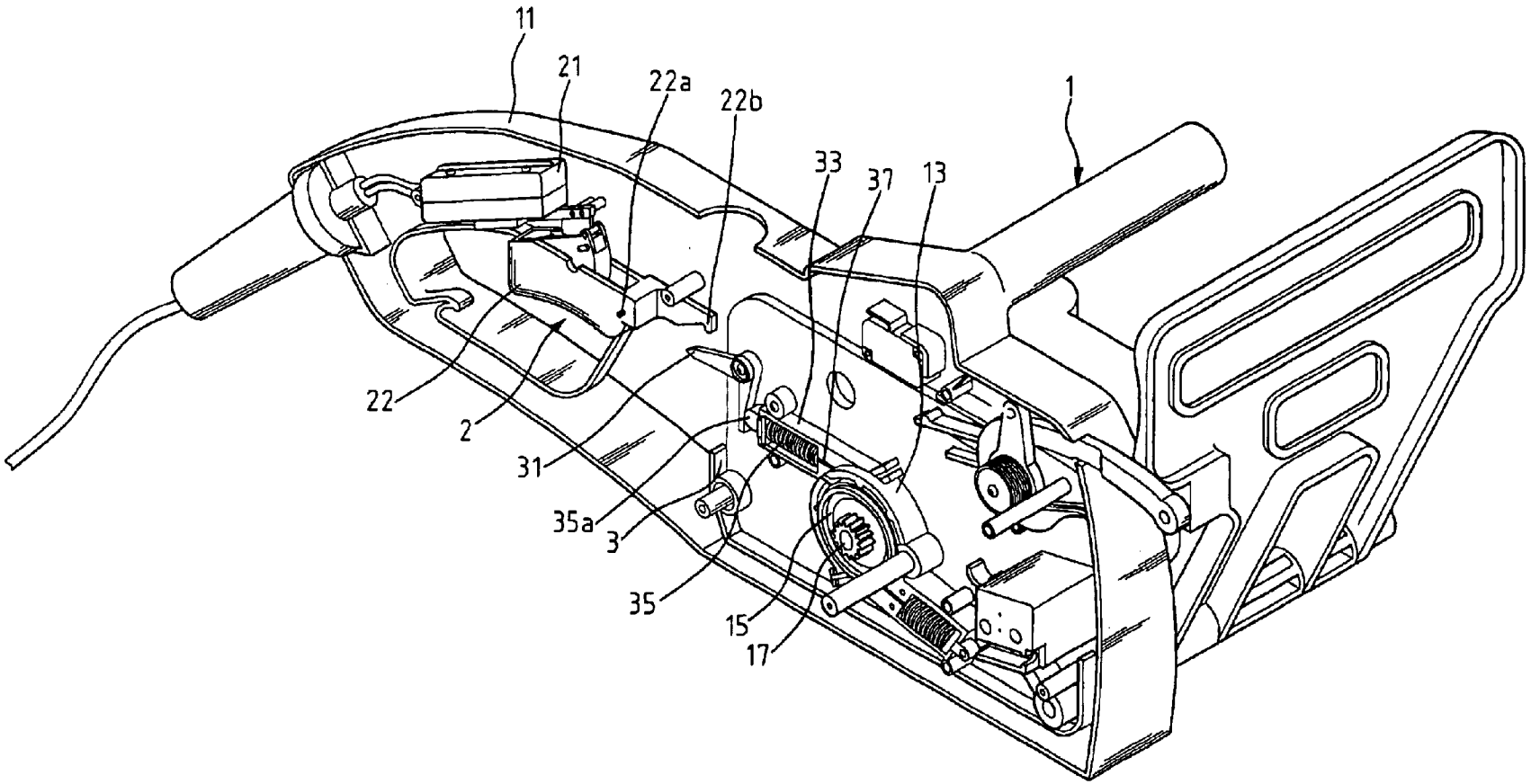
FIG. 1 is a perspective view showing a trigger-brake combined structure of the present invention for tool machine.

With referring to the drawings and in particular to FIG. 1, a trigger-brake structure for tool machine provided by the present invention comprises a trigger device (2) and a brake device (3) in a machine base (1) of a power-driven manual tool machine to hence control an inside power source of the tool machine.

Figure 2:
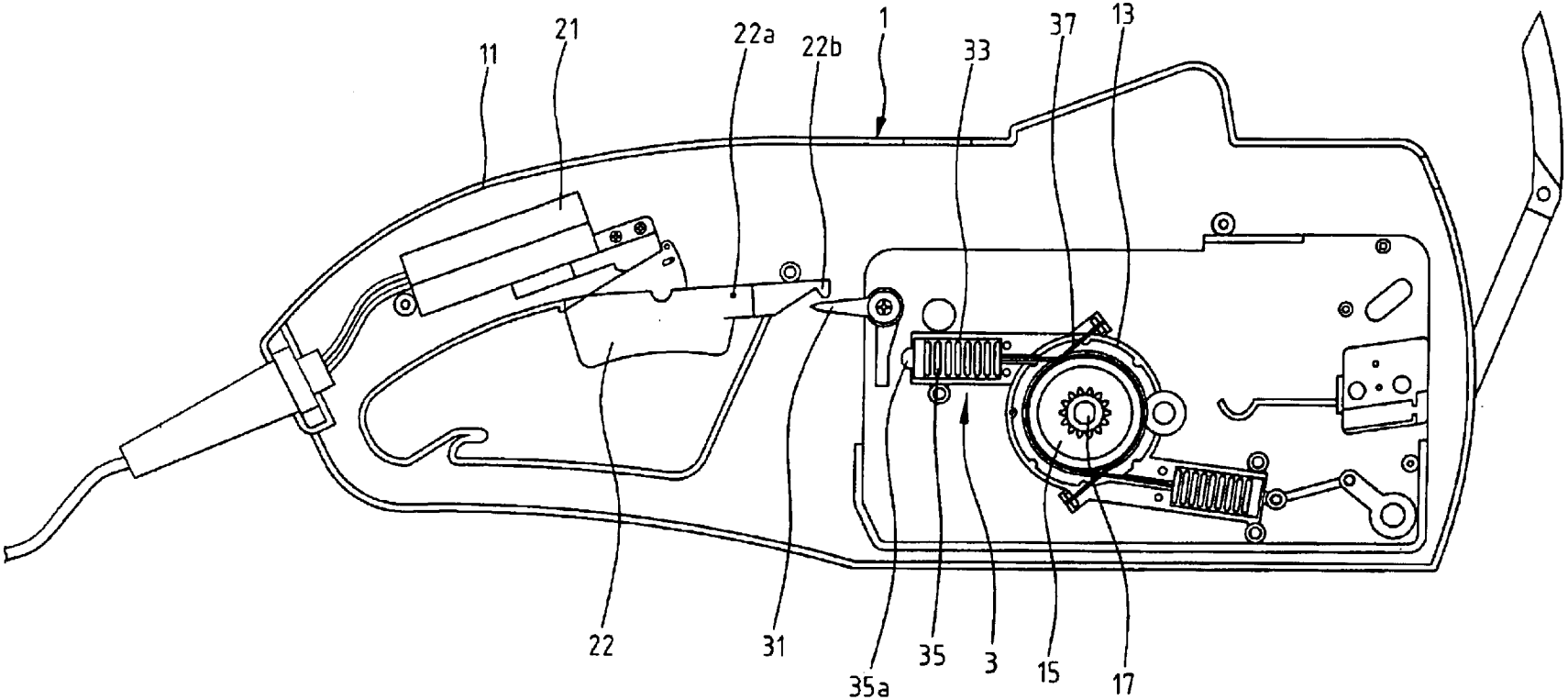
FIG. 2 is a side elevational view showing an initial state of the trigger-brake structure of the present invention for tool machine.
Figure 3:
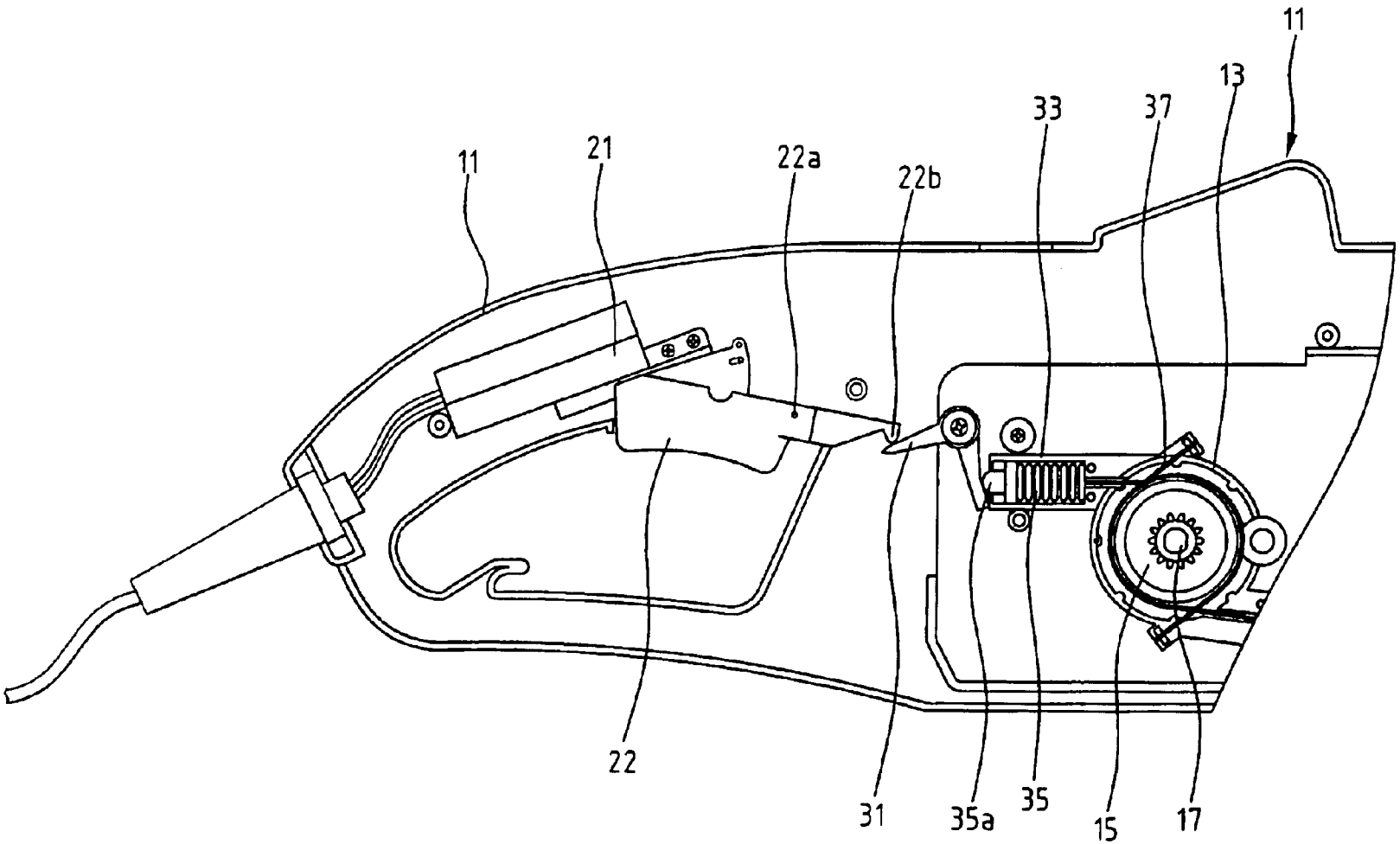
FIG. 3 is a schematic view showing the brake release operation of the trigger-brake structure of the present invention for tool machine.

Also referring to FIGS. 2 and 3, the machine base (1) is a hollow housing having a grip (11) formed at a rear end thereof to facilitate a user to hold the machine base. Inside the machine base (1), an empty cavity (13) is available to accommodate a transmission axle (15) for power transmission, where the transmission axle (15) is connected with a power source for power output through an output axle (17).

The trigger device (2) is comprised of a self-restoring switch (21) and a trigger (22), in which the self-restoring switch (21) is disposed in the grip (11) of the machine base (1); the trigger (22) is provided with a pivot **(22*a*) at the front end thereof and thereby pivotally installed in the machine base (1), and the pivot (22*a*) is extended forwards to form an extension rod (22*b*) such that the self-restoring switch (21) could be started when the trigger (22)** rotates.

The brake device (3) is comprised of a lever (31), a guiding channel (33), a spring (35), and a spring leaf (37), in which the lever (31) is pivotally connected with a supporting pin defined on an inner wall of the machine base (1), and the front end thereof is matched with the spring (35) while the rear end thereof is matched with the extension rod **(22*b*) of the trigger (22); the guiding channel (33) is fixed in a hollow interlayer; the spring (35) is disposed limited in the guiding channel (33), and has a flange (35*a*) formed at one end thereof to match with the extension rod (22*b*) of the trigger (22); and the spring leaf (37) is arranged to surround and invest a flexible plate of the transmission axle (15), and one end thereof fixedly contacts the flange (35*a*) of the spring (35) while the other end contacts the machine base (1)**.

In the brake device (3), the tension of the spring leaf (37) is enhanced by pulling and stretching the flange **(35*a*) of the spring (35) to hence enable the spring leaf (37) as well as the transmission axle (15)** to produce sufficient frictional braking force.

In the brake device (3), suppose the spring leaf (37) has enough restoring force, then it is situated under a fully-stretched state and it can create a sufficient frictional force to brake the transmission axle (15) when no acting force of the trigger (22) of the trigger device (2) is applied and transmitted thereto.

As shown in FIG. 2, since the extension rod (22*b*) at the front end of the trigger (22) does not apply any force to the lever (31) in this state, the lever (31) does not apply any force to the flange (35*a*) of the spring (35) accordingly to make the spring (35) pull the spring leaf (37) to stretch in its full length such that a considerable frictional force is created between the spring leaf (37) and the transmission axle (15) to slow down or stop the rotation of the latter.

When the trigger (22) of the trigger device (2) is pulled up, the self-restoring switch (21) is triggered to start a power source in the machine base (1), and meanwhile, the trigger would rotate surrounding the pivot (22*a*) to make the extension rod (22*b*) rotate too. Then, the extension rod (22*b*) is arranged to exert a force to one end of the lever (31) such that the other end of the lever (31) would touch and push the flange (35*a*) to have the spring (35) contracted, the tension of the spring leaf (37) decreased to result in a loosened state of the spring leaf, and the frictional force between the spring leaf (37) and the transmission axle (15) weakened to no more affect rotation of the transmission axle (15), so that the power source in the machine base (1) will drive the transmission axle (15) for outputting power through the output axle (17).

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A trigger-brake structure for tool machine, comprising a trigger device and a brake device arranged in a machine base, the trigger device employed for starting a power switch while the brake trigger for constraining power transmission, in which a transmission axle is disposed in the machine base for providing power transmission; a trigger has a pivot formed at a front end thereof, and arranged in the machine base and further extended forwards to form an extension rod for moving a self-restoring switch to start the power source in the machine base when the trigger swivels; the brake device is comprised of a lever, a guiding channel, a spring, and a spring leaf, in which the lever is pivotally connected with a supporting pin defined on an inner wall of the machine base, and a front end thereof is designed to mate with the spring while a rear end thereof is designed to mate with the extension rod of the trigger, the guiding channel is fixedly disposed in a hollow interlayer of the machine base; the spring is located and limited in the guiding channel, and a flange is formed at one end thereof to mate with the extension rod of the trigger; and the spring leaf is a flexible plate surrounding the transmission axle, and one end thereof fixedly contacts the flange of the spring while the other end contacts the machine base to thereby change the frictional force of contact surface between the spring leaf and the transmission axle.

* * * * *